US010775039B2

(12) United States Patent
Heim et al.

(10) Patent No.: US 10,775,039 B2
(45) Date of Patent: Sep. 15, 2020

(54) METHOD FOR MANAGING A SHUT DOWN OF A BOILER

(71) Applicant: GENERAL ELECTRIC TECHNOLOGY GMBH, Baden (CH)

(72) Inventors: Michael Heim, Horb (DE); Thomas Ferrand, Stuttgart (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 651 days.

(21) Appl. No.: 14/533,568

(22) Filed: Nov. 5, 2014

(65) Prior Publication Data

US 2015/0122202 A1 May 7, 2015

(30) Foreign Application Priority Data

Nov. 6, 2013 (EP) ..... 13191735.3

(51) Int. Cl.
*F22B 35/00* (2006.01)
*F01K 13/02* (2006.01)
*F22B 37/22* (2006.01)

(52) U.S. Cl.
CPC ..... *F22B 35/00* (2013.01); *F01K 13/02* (2013.01); *F22B 37/22* (2013.01)

(58) Field of Classification Search
CPC ..... F22B 35/00; F22B 35/04; F22B 35/125; F22B 35/14
USPC ..... 122/504
See application file for complete search history.

(56) References Cited

U.S. PATENT DOCUMENTS 4,145,996 A * 3/1979 Brandes ..... F22B 37/14 122/494
5,012,766 A * 5/1991 Nigawara ..... F16P 3/08 110/193
6,019,070 A * 2/2000 Duffy ..... F22B 1/1815 122/209.1
9,535,409 B1 * 1/2017 Cassity ..... F22B 1/006
2001/0049931 A1 * 12/2001 Liebig ..... F01K 23/10 60/772

(Continued)

FOREIGN PATENT DOCUMENTS

CN 1075789 A 9/1993
CN 102537927 A 7/2012

(Continued)

OTHER PUBLICATIONS

Machine Translation & Notification of Reasons for Refusal issued in connection with corresponding JP Application No. 2014-226101 dated Sep. 4, 2018.

(Continued)

*Primary Examiner* — Grant Moubry
*Assistant Examiner* — John E Bargero
(74) *Attorney, Agent, or Firm* — Grogan, Tuccillo & Vanderleeden, LLP

(57) ABSTRACT

The method for managing a shut down of a boiler having a duct and heat exchanging components is provided. The heat exchanging component having tubed heat exchanging surfaces within the duct and headers outside the duct. The method includes regulating the temperature of the headers during shut down to a temperature close to the one expected for the steam moving from the tubed heat exchanging surfaces into the headers at a starting up following the shut down.

13 Claims, 1 Drawing Sheet

(56) References Cited

U.S. PATENT DOCUMENTS

2012/0036828 A1* 2/2012 Hu ..... F01D 21/06
60/39.182

FOREIGN PATENT DOCUMENTS

| | | | | |
|---|---|---|---|---|
| EP | 1 154 127 | A2 | | 11/2001 |
| GB | 926618 | A | | 5/1963 |
| JP | S6021802 | U | * | 1/1983 |
| JP | S60-21802 | U1 | | 2/1985 |
| JP | H03-51601 | A | | 3/1991 |
| JP | H03-286901 | A | | 12/1991 |
| JP | H05-96703 | U1 | | 12/1993 |
| WO | 00/17576 | A1 | | 3/2000 |

OTHER PUBLICATIONS

Machine Translation and First Office Action and Search issued in connection with corresponding CN Application No. 201410618105.3 dated Oct. 11, 2017.

* cited by examiner

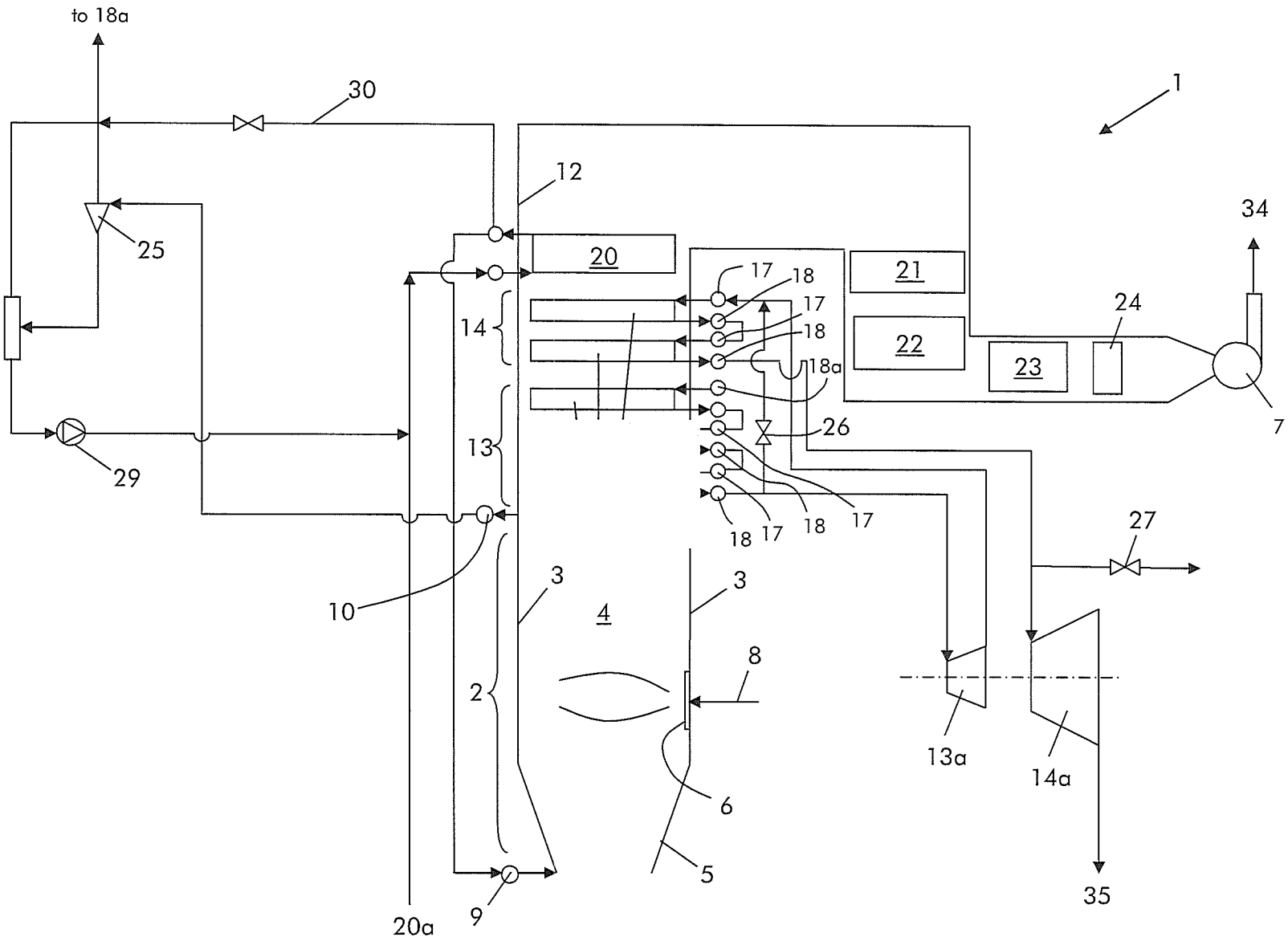
1
34
7
24
23
21
22
27
35
14a
13a
17
18
18a
26
3
8
6
5
4
20
12
14
13
2
9
10
20a
30
25
29
to 18a

METHOD FOR MANAGING A SHUT DOWN OF A BOILER

CROSS-REFERENCE TO RELATED APPLICATIONS

This application claims priority to European application 13191735.3 filed Nov. 6, 2013, the contents of which are hereby incorporated in its entirety.

TECHNICAL FIELD

The present disclosure relates to a method for managing a shut down of a boiler.

BACKGROUND

FIG. 1 shows an example of a boiler 1 having an evaporator 2 defined by walls 3 (tubed walls, preferably finned tubed wall); the walls 3 define a chamber 4 and the bottom of the walls 3 defines a hopper 5.

One or also more than one walls 3 carry a firing system 6 comprising a fan for an oxidizer like air and a fuel supply 8 for coal, oil, gas, etc.

The tubed walls 3 are connected to inlet headers 9 and outlet headers 10; water is collected at the inlet headers 9 and is distributed through the tubes of the tubed walls 3 and, after passing through the tubed walls 3, steam (or a mixture of steam and water or steam containing some water to a low extent) is collected at the outer headers 10. The headers 9 and 10 are outside of the chamber 4. Naturally also other types of evaporators are possible.

Above the evaporator 2, the boiler 1 has a duct 12 that houses in series, from the bottom to the top, a superheater 13 for heating the steam directed to a high pressure user (like for example a high pressure turbine 13*a* of a power plant) and a reheater 14 for heating the steam discharged from the high pressure user and directed to a medium or low pressure user (like for example a medium or low pressure turbine 14*a* of a power plant).

The superheater 13 includes heat exchanging components having tubed heat exchanging surfaces 16 connected to inlet headers 17 and outlet headers 18; for example the tubed heat exchanging surfaces 16 can be tubed coils or tubed panels.

The attached FIGURE shows an example of a superheater 13 including three heat exchanging components each having tubed heat exchanging surfaces 16, inlet header 17 and outlet header 18.

The reheater 14 has a structure similar to the structure of the superheater 13.

The reheater 14 includes heat exchanging components that comprise tubed heat exchanging surfaces 16, such as tubed coils or tubed panels. The tubed heat exchanging surfaces 16 are connected to inlet headers 17 and outlet headers 18.

The attached FIGURE shows an example of a reheater 14 including two heat exchanging components each having tubed heat exchanging surfaces 16, inlet header 17 and outlet header 18.

Above the reheater 14 there is provided an economizer 20, to pre-heat water coming from a feedwater source 20*a* and directed to the evaporator 2. The economizer 20 is also provided with inlet headers and outlet headers.

In the duct 12, downstream the economizer 20, there are typically installed a catalyzer 21 (if needed according to the emission requirements) for reducing the $NO_x$ content of the flue gas, a preheater 22 for preheating air that is supplied into the chamber 4 for combustion of the fuel, a dust removal unit 23 such as a filter or electrostatic precipitator for solid particles removal from the flue gas; in some cases a damper 24 for regulating the opening of the flue gas duct 12 and a fan 7 for transportation of the flue gas to the stack 34 can also be provided.

In some cases, the economiser 20 can be separated in two parts, one upstream the catalyzer 21 and one downstream the catalyzer 21.

During operation, water passes through the economizer 20 where it starts heating and then it is supplied through the headers 9 to the tubed walls 3. While passing through the tubed walls 3 water evaporates, generating steam that is collected at the headers 10 and is directed (through a separating system 25 to remove possible liquid droplets) to the super heater 13 via the headers 18*a*. The first stage of the super heater 13 can either be the upper (vertical) boiler enclosure wall or the internal hanger tubes ending in the first super heater bundle.

Downstream of the superheater 13, superheated steam is directed to the high pressure turbine 13*a* for example of a power plant or for other high pressure user or to the reheater 14 inlet via the high pressure bypass valve 26.

Steam from the high pressure turbine 13*a* or other high pressure user is collected at the inlet header 17 of the reheater 14 and, after passing through the reheater 14 it is collected in the outlet header 18 from which it is directed to the medium or low pressure turbine 14*a* or medium or low pressure user or via the low pressure bypass valve 27 to the condenser 35 provided downstream of the steam turbine.

Liquid droplets collected at the separating system 25 are directed back through the recirculation pump 29 to the economizer 20.

During shut down the firing system 6 is stopped, the high pressure turbine 13*a* and the medium or low pressure turbine 14*a* are disconnected and the valves 26 and 27 are closed.

For this reason, the steam passing through the superheater 13 and reheater 14 is stopped, i.e. there is no further steam flow within the heating surfaces 16 of the superheater 13 and the reheater 14.

Nevertheless, during shut down air keep circulating through the chamber 4, this is due for example to purging or natural draft. For example, often the fan 7 operates for maintaining an underpressure inside the boiler enclosure also during shut down. This causes an air flow at temperature lower than the temperature of the steam within the superheater 13 and reheater 14.

The flow increases the cooling of the steam contained within the tubed heat exchanging surfaces 16 of the superheater 13 and reheater 14. This cooling can be large, because the thickness of the surfaces of the tubed heat exchanging surfaces 16 is usually small, such that the thermal storage capacity of the tube walls is low.

In contrast, the steam contained within the headers 17, 18 only undergoes a very limited cooling.

In fact, the headers 17, 18 have a large wall thickness and therefore they also have a large thermal storage capacity.

In addition, the headers 17, 18 are insulated such that substantial cooling from the outside of the headers 17, 18 is prevented; moreover, since there is no steam flow inside the headers 17, 18, no substantial cooling from the inside of the headers 17, 18 occurs.

As a consequence, the temperature of the steam and of the header 17, 18 of the reheater 14 and superheater 13 (i.e. of the material of the header 17, 18) will decrease only with a very small gradient (i.e. the temperature of this steam slowly decreases), but the temperature of the steam contained in the tubed heat exchanging surfaces 16 of the reheater 14 and superheater 13 sensibly drops.

When the boiler 1 is start up again after shut down, the firing system 6 is started and the high pressure bypass valve 26 and the low pressure bypass valve 27 are opened.

Opening the high pressure bypass valve 26 and the low pressure bypass valve 27 causes steam circulation through the tubed heat exchanging surfaces 16 and the headers 17, 18 of the superheater 13 and the reheater 14. This circulation causes steam at a low temperature (because it was contained within the tubed heat exchanging surfaces 16 during shut down) to pass through the headers 17, 18 that have a much higher temperature.

This circulation thus causes thermal stress of the material of the header 17, 18 and possibly a reduction of the lifetime.

SUMMARY

An aspect of the disclosure includes providing a method by which the thermal stress of the headers of the superheater and/or reheater can be limited.

These and further aspects are attained by providing a method in accordance with the accompanying claims.

BRIEF DESCRIPTION OF THE DRAWINGS

Further characteristics and advantages will be more apparent from the description of a preferred but non-exclusive embodiment of the method, described with reference to the non-limiting accompanying drawings, in which:

FIG. 1 is a schematic view of a boiler.

DETAILED DESCRIPTION

In the following reference to the boiler of FIG. 1 is made.

The method can be applied to any boiler also different from the one shown. For example the walls 3 can extend up to the top of the boiler (i.e. they can define the duct 12 and house the tubed coils or tubed panels 16). The walls can either be completely used as evaporator or can be divided in evaporator (lower part) and superheater (upper part). In addition the evaporator can have a different structure than the tubed walls 3.

The method is preferably implemented to limit the stress of the headers 17, 18 of the superheater 13, but it can also be conveniently used to limit the stress to the headers 17, 18 of the reheaters 14 or of other parts of the boiler 1.

The method comprises regulating the temperature of the headers 17, 18 during shut down to a target temperature that is a function of the expected temperature for the steam moving from the tubed heat exchanging surfaces 16 into the headers 17, 18 at a starting up following the shut down. The target temperature is for example the expected temperature for the steam moving from the tubed heat exchanging surfaces 16 into the headers 17, 18 or a temperature preferably close to this expected temperature and in this last case the temperature is lower than the expected temperature.

In particular this temperature regulation is a cooling of the headers 17, 18.

This cooling is mainly done after shut down, that means without additional use of expensive fuel, only by using the boiler pressure storage capacity and the boiler heat content in an appropriate way.

Thanks to this controlled cooling of the headers 17, 18, when the boiler 1 is started up after shut down, the steam moves from the tubed heat exchanging surfaces 16 through the the headers 17, 18 and since the temperature of the steam does not differ from the temperature of the headers 17, 18 or the difference is a limited controlled and calculated difference, the thermal stress undergone by the headers 17, 18 is limited.

Preferably regulating the temperature of the heaters 17, 18 comprises maintaining a flow through the headers 17, 18 during the shut down or at least part of the shut down.

In fact, if steam keeps circulating through the tubed heat exchanging surfaces 16 and headers 17, 18, the headers 17, 18 are cooled by the steam that circulates through them and that is in turn cooled by the flow through the duct 12.

Maintaining the flow through the headers 17, 18 can be implemented by maintaining a steam flow through the control valve 26 and valve 27. In fact, the flow through the valve 26 allows cooling of the headers 17, 18 of the superheater 13 and the flow through the valve 27 allows to cool the headers 17, 18 of the reheater 14. Preferably the mass flow through the valve 26 and 27 is less than 10% of the nominal mass flow.

In a preferred embodiment, the method is implemented in connection with the tubed heat exchanging surfaces 16 of the superheater 13 and the control valve 26 is downstream of the superheater 13.

In addition, a gas flow is preferably maintained through the duct 12 during shut down. Maintaining a gas flow through the duct 12 includes operating the fan 7. For example the fan 7 is operated at minimum load or at a load less than 10% of its nominal mass flow. Operating the fan 7 is anyhow not mandatory and natural draft can suffice for air circulation.

The method can also comprise regulating the pressure within the boiler, i.e. within the heat exchanging components; pressure regulation can be done before shut down or during shut down. Preferably such a regulation aims at increasing the pressure within the boiler 1.

In a first example, regulating the pressure includes regulating the high pressure by-pass control valve 26 or the turbine inlet valve.

In a different example, regulating the pressure includes circulating water through the economizer 20 and evaporating at least partly water passing through the economizer 20. Circulation through the economizer 20 can be achieved by stopping the recirculation pump 29 and opening the line 30 (eco steaming line) provided between the top level of the economiser and the separating system 25.

Continuously operating the fan 7 for a certain time after shut down or using the natural boiler draft causes a permanent heat input on the economiser surfaces with steam production. This steam production is used to improve the pressure maintenance during the header cooling process. Maintaining a small feedwater flow (continuous or discontinuous) avoids a complete steaming of the economiser.

Naturally the features described may be independently provided from one another.

In practice the materials used and the dimensions can be chosen according to requirements and to the state of the art.

The invention claimed is:

1. A method for managing a shutdown of a boiler comprising:

providing a duct, providing at least a heat exchanging component;

wherein the at least a heat exchanging component includes:

tubed heat exchanging surfaces within the duct, headers outside the duct, the headers being connected to the tubed heat exchanging surfaces, the headers and the tubed heat exchanging surfaces containing steam; regulating the temperature of the headers during shut down to a target temperature that is a function of the expected temperature for the steam moving from the tubed heat exchanging surfaces into the headers at a starting up following the shutdown; and wherein regulating the temperature of the headers includes maintaining a steam flow through the headers after shutdown of the firing system by maintaining a steam circulation from the tubed heat exchange surfaces connected to the respective headers and through said headers.

2. The method according to claim 1 further comprising: providing a high pressure bypass control valve downstream of the at least a heat exchanging component, configured such that maintaining a flow through the headers includes maintaining a steam flow through the high pressure bypass control valve.

3. The method according to claim 2 further comprising: wherein the heat exchanging component is a superheater and the high pressure bypass control valve is downstream of the superheater.

4. The method according to claim 1 further comprising: maintaining a gas flow within the duct during shutdown.

5. The method of claim 4 further comprising: wherein the boiler includes a fan for gas circulation through the duct, configured such that maintaining a gas flow includes operating the fan.

6. The method of claim 5 further comprising: wherein operating the fan includes operating the fan at minimum load.

7. The method of claim 6 further comprising: wherein operating the fan includes operating the fan at less than 10% of its nominal mass flow.

8. The method according to claim 1 further comprising: regulating the pressure within the boiler during shutdown or before shutdown.

9. The method of claim 4 further comprising: wherein the boiler further comprises one or more high pressure bypass control valves downstream of a superheater and/or one or more low pressure by-pass control valves downstream of the reheater, configured such that regulating the pressure includes regulating the high pressure bypass control valves and/or the low pressure by-pass control valves.

10. The method according to claim 8 further comprising: wherein the boiler further comprises an economizer, configured such that regulating the pressure includes circulating water through the economizer and evaporating at least partly water passing through the economizer.

11. The method according to claim 10 further comprising: wherein regulating the pressure further includes circulating air through the duct.

12. The method of claim 11 further comprising: wherein the boiler includes a fan for gas circulation through the duct, configured such that circulating air includes operating the fan.

13. The method according to claim 1 further comprising: wherein the target temperature is the expected temperature for the steam moving from the tubed heat exchanging surfaces into the headers or a temperature lower than the expected temperature.

* * * * *